US005743573A

United States Patent [19]

Huang

[11] Patent Number: 5,743,573

[45] Date of Patent: Apr. 28, 1998

[54] ADJUSTABLE DEAD BOLT ASSEMBLY FOR TUBULAR DOOR LOCKS

[75] Inventor: Lan Shi Huang, Kaohsiung, Taiwan

[73] Assignee: Taiwan Fu Hsing Industry Co., Ltd., Kaohsiung Hsien, Taiwan

[21] Appl. No.: 761,754

[22] Filed: Dec. 5, 1996

[51] Int. Cl.[6] ..... E05C 1/00

[52] U.S. Cl. ..... 292/1.5; 292/DIG. 60

[58] Field of Search ..... 292/1.5, DIG. 60, 292/337

[56] References Cited

U.S. PATENT DOCUMENTS

| | | | |
|---|---|---|---|
| 4,750,766 | 6/1988 | Shen | 292/1.5 |
| 4,804,216 | 2/1989 | Marotto | 292/DIG. 60 |
| 5,354,109 | 10/1994 | Lin | 292/1.5 |
| 5,490,695 | 2/1996 | Shiue | 292/1.5 |

*Primary Examiner*—Flemming Saether
*Attorney, Agent, or Firm*—Bacon & Thomas

[57] ABSTRACT

An adjustable dead bolt assembly includes a lock case mounted to a face plate, a pair of plates fixed to the lock case, and an actuating wheel. Each plate includes an oblong hole defined therein, wherein at least one of the plates includes a recessed section formed in an inner side thereof, the recessed section having a sidewall extending along at least one of two lateral sides of the oblong hole. At least one of the plates includes at least one protruded section formed in the sidewall of the recessed section, the protruded section being located midway along a lateral side defining the part of the oblong hole. The actuating wheel is slidably mounted between the plates and includes a spring mounted therearound in a compressed manner such that the spring may be expanded into the recessed section around the associated oblong hole to provide a positioning effect for the actuating wheel.

3 Claims, 3 Drawing Sheets

ADJUSTABLE DEAD BOLT ASSEMBLY FOR TUBULAR DOOR LOCKS

BACKGROUND OF THE INVENTION

1. Field of the Invention

The present invention relates to an adjustable dead bolt assembly for tubular door locks.

2. Description of the Related Art

Various kinds of tubular door locks have been developed and widely used, some of which are disclosed in the following U.S. Pat. Nos.: U.S. Pat. No. 4,639,025 to Fann et al., filed Mar. 17, 1986, entitled "ADJUSTABLE DEAD BOLT ASSEMBLY"; U.S. Pat. No. 4,804,216 to Marotto, filed Feb. 1, 1988, entitled "CONVERTIBLE BACKSET LATCH MECHANISM"; U.S. Pat. No. 4,850,626 to Gallego, filed Mar. 2, 1988, entitled "IMPROVED LATCH BOLT WITH SELECTIVELY VARIABLE DRIVING PIN DEPTH"; U.S. Pat. No. 4,890,871 to Lin, filed Nov. 17, 1988, entitled "TUBULAR DOOR LOCK WITH AN ADJUSTABLE DEVICE FOR SETTING THE DEAD BOLT"; U.S. Pat. No. 4,927,195 to Wu et al., filed Nov. 8, 1988, entitled "DUAL BACKSET DEADBOLT ASSEMBLY"; and U.S. Pat. No. 4,927,199 to Wu et al., filed Sep. 23, 1988, entitled "LATCH ASSEMBLY FOR CYLINDER LOCK". In these patents, the configurations thereof are complicated. Applicant's U.S. Pat. No. 5,257,838, filed on Nov. 24, 1992 and entitled "DEAD BOLT ASSEMBLY FOR TUBULAR DOOR LOCKS", discloses a door lock which includes a dead bolt slidably received in a cylinder and having a pair of extensions extended outwardly beyond the cylinder, a pair of plates fixed to the cylinder, an oblong hole defined in each plate, an actuating wheel slidably engaged in the oblong holes of the plates and including a pair of teeth for engagement with the protrusions of the extensions when the actuating wheel rotates. A resilient member is fixed to one of the plates for positioning the actuating wheel. However, manufacture of the resilient member 33 is troublesome and has a high cost due to its having a specific shape. In addition, hooks 321 and stops 322 are required on the plate so as to stably retain the resilient member 33 in position.

The present invention is intended to provide an improved design which mitigates and/or obviates the above problems.

SUMMARY OF THE INVENTION

In accordance with the invention, an adjustable dead bolt assembly comprises a lock case mounted to a face plate, a pair of plates fixed to the lock case, and an actuating wheel. A dead bolt is slidably received in the lock case and includes a pair of operative rods attached to the dead bolt to move therewith, each operative rod including a first protrusion and a second protrusion projecting therefrom.

Each plate includes an oblong hole defined therein, wherein at least one of the plates includes a recessed section formed in an inner side thereof, the recessed section including a sidewall extending along at least one of two lateral sides of the oblong hole. At least one of the plates includes at least one inwardly extending protruded section formed in the sidewall of the recessed section, the protruded section being located midway along a lateral side of the oblong hole.

The actuating wheel is slidably mounted between the plates and includes a pair of teeth for selectively engaging with the first protrusions and the second protrusions. The actuating wheel further includes a shoulder formed on a first side thereof. A spring is mounted around the shoulder in a compressed manner such that the spring may be expanded into the recessed section around the associated oblong hole to provide a positioning effect for the actuating wheel.

Preferably, a retainer plate is mounted to the inner side of one of the plates, the retainer plate including a hole and a projection. The actuating wheel further comprises a second shoulder formed on the other side thereof and is fittingly received in the hole of the retainer plate. The actuating wheel further comprises a flange against which the projection of the retainer plate bears.

Preferably, each plate includes two protruded sections respectively formed on the lateral sides defining the part of the oblong hole, and a distance between the two protruded sections allowing passage of the actuating wheel therebetween from one end of the oblong hole to the other end of the oblong hole.

Other objects, advantages, and novel features of the invention will become more apparent from the following detailed description when taken in conjunction with the accompanying drawings.

DESCRIPTION OF THE PREFERRED EMBODIMENT

Figure 1:
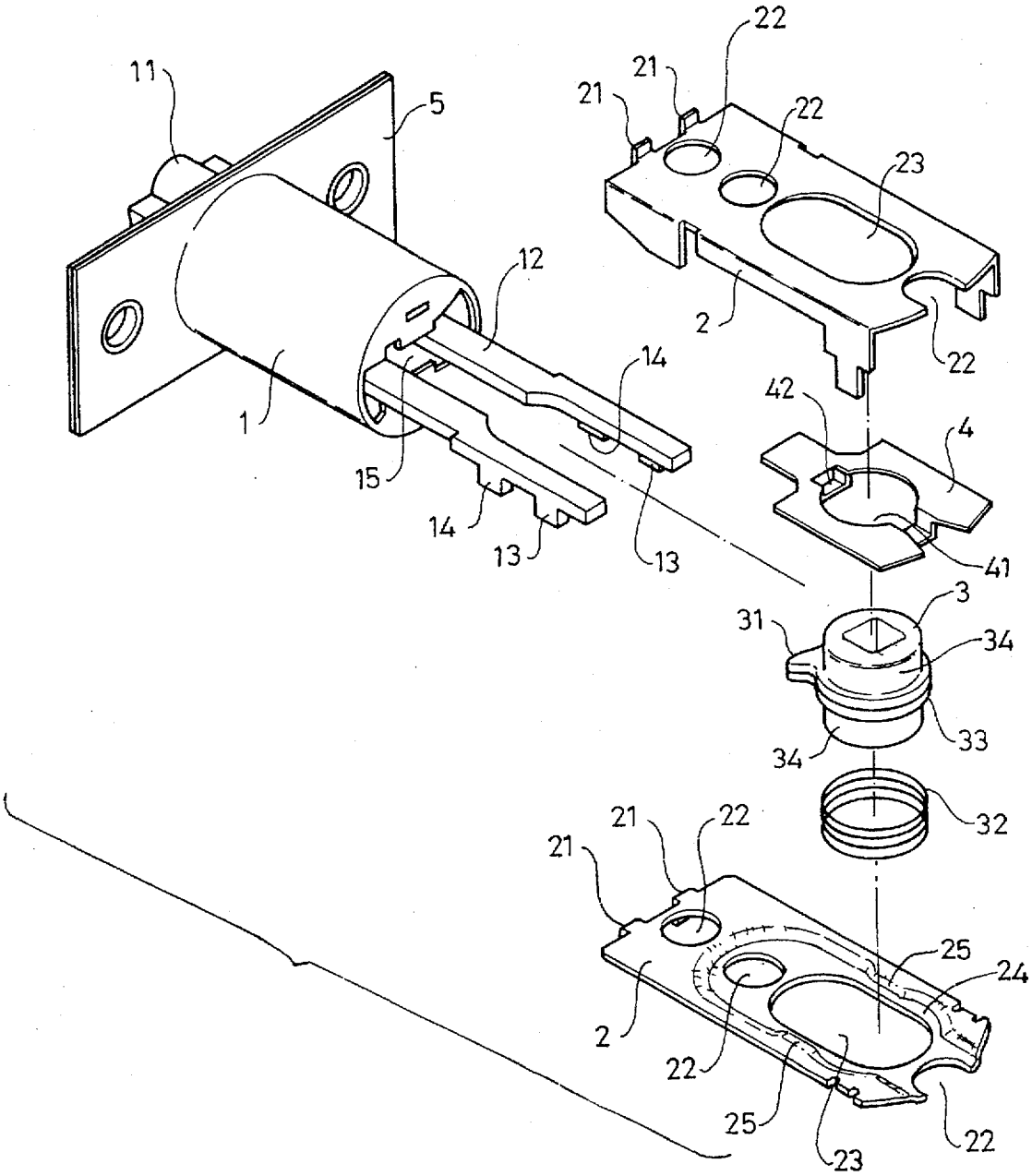
FIG. 1 is an exploded perspective view of an adjustable dead bolt assembly for a tubular door lock in accordance with the present invention.

Referring to the drawings and initially to FIG. 1, a dead bolt assembly in accordance with the present invention generally includes a lock case 1 mounted to a face plate 5, a pair of plates 2, and an actuating wheel 3. The lock case 1 includes a dead bolt 11 partially and slidably mounted therein. The lock case 1 further includes a pair of operative rods 12 attached to the dead bolt 11 to move therewith. Each operative rod 12 includes a pair of protrusions 13 and 14 projecting therefrom.

Each plate 2 includes a pair of hooks 21 at a first end thereof for being secured into an engaging slot 15 defined in the lock case 1. Each plate 2 further includes three holes 22 defined therein for fixing the plates 2 to a door plate (not shown) such that the plates 2 and the lock case 1 are fixed within the door plate. Each plate 2 further includes an oblong hole 23 defined therein for slidably receiving the actuating wheel 3. In order to provide a stable sliding motion of the actuating wheel 3, at least one of the plates 2 includes a recessed section 24 formed in an inner side thereof, the recessed section 24 defined by a sidewall extending along at least one of two lateral sides of the oblong hole 23. For easy manufacture, the recessed section 24 may be further extended in the manner shown in FIG. 1. In addition, the plate 2 includes at least one inwardly protruded section 25 formed in the sidewall of recessed section 24, the protruded section 25 being located at substantially midway along a lateral side of the oblong hole 23 and is directed inwardly towards hole 23. In this embodiment, there are two protruded sections 25 respectively formed on the two lateral sides of the oblong hole 23, and the distance between the two protruded sections 25 is sufficient to permit passage of the actuating wheel 3 therebetween from one end of hole 23 to the other end of hole 23.

The actuating wheel 3 is slidably mounted between the plates 2 and may be in the form of a single wheel or consist of two half pieces which may rotate independently. The actuating wheel 3 includes a pair of teeth 31 for engaging with either one pair of the protrusions 13 and 14. The actuating wheel 3 may slide along a lateral direction of the plate 2 so as to be retained in either end of the oblong hole 23 on opposite sides of protruded sections 25. A resilient element, e.g., a coil spring 32 is mounted around a first of two shoulders 34 formed on one side of the actuating wheel 3 in a compressed manner such that the spring 32 may be expanded into the recessed section 24 around the oblong hole 23 to provide a positioning effect for the actuating wheel 3. When the actuating wheel 3 slides laterally in the oblong hole 23, the spring 32 is further slightly radially compressed when passing through the protruded sections 25 and then again expands radially into the recessed section 24 to provide the required positioning effect for the actuating wheel 3.

Figure 3:
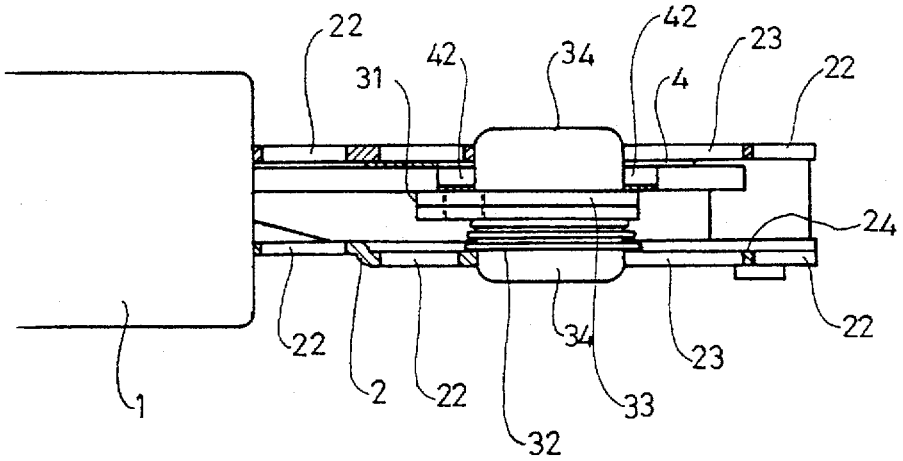
FIG. 3 is a sectional view taken along line 3—3 in FIG. 2.
Figure 4:
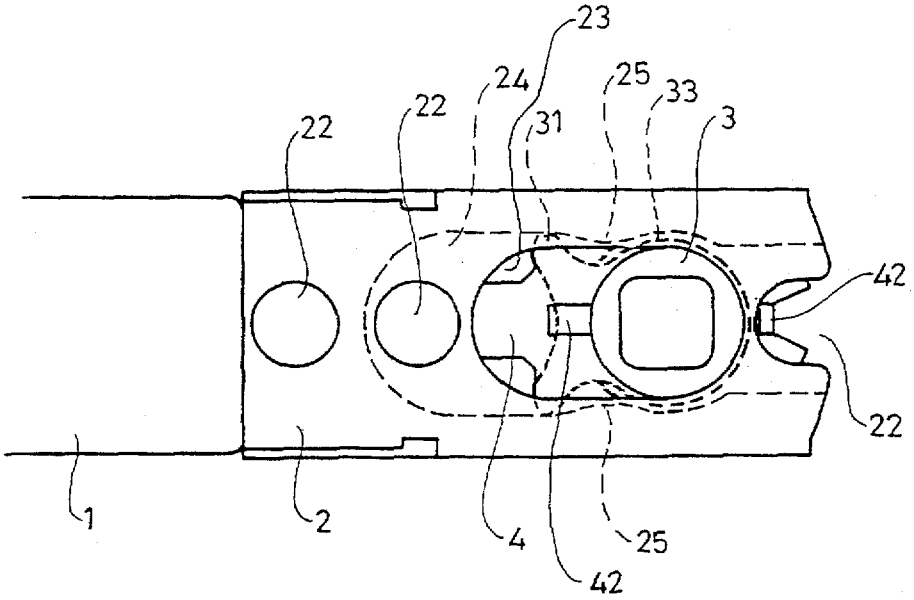
FIG. 4 is a side elevational view similar to FIG. 2, illustrating operation of the dead bolt assembly.

To keep stable lateral movements of the actuating wheel 3 between the plates 2, a retainer plate 4 is mounted to the inner side of one of the plate 2 and includes a hole 41 for fittingly receiving the second of the two shoulders 34 formed on the other side of the actuating wheel 3. In addition, the retainer plate 4 includes two spaced projections 42 which bear against a flange 33 formed between the two shoulders 34 of the actuating wheel 3. As can be seen in FIG. 3, the two shoulders 34 are respectively extended into the oblong holes 23 such that the actuating wheel 3 is slidable between the plates 2.

Figure 2:
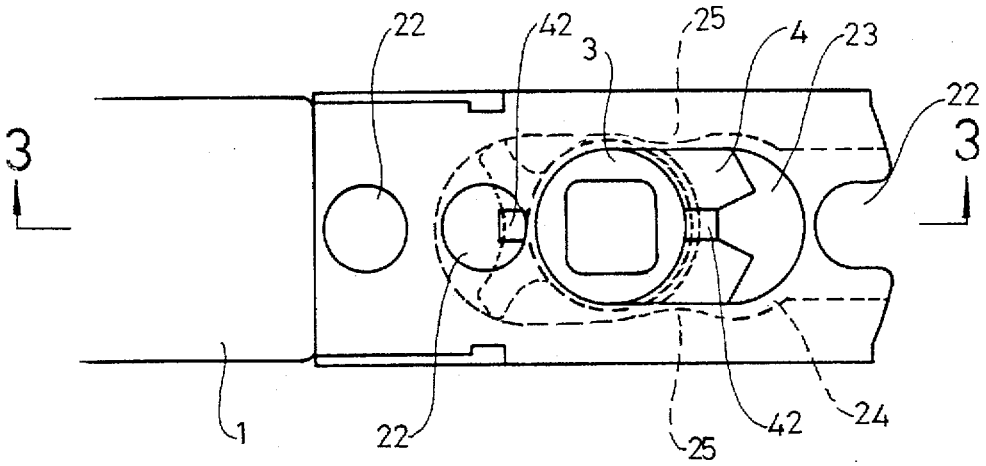
FIG. 2 is a side elevational view of the dead bolt assembly.

Referring to FIGS. 2 and 3, when applied to a dead bolt having a smaller backset, the actuating wheel 3 is in a first position (e.g., the left side of the oblong hole 23), in which the spring 32 is retained in the recessed sections 24 of the plates 2, thereby positioning the actuating wheel 3.

Referring to FIGS. 2 and 3, when applied to a dead bolt having a larger backset, the actuating wheel 3 is slid to a second position (the right side of the oblong hole 23), in which the spring 32 is again retained in the recessed sections 24 of the plates 2, thereby positioning the actuating wheel 3.

According to the above description, it is appreciated that the actuating wheel 3 can be positioned without particular design in the plates 2 as the recessed sections 24 and the protruded sections 2B can be formed by punching the plates 2. In addition, the spring 32 can be a readily available coil spring without requiring specific design and troublesome, expensive manufacture therefor.

Although the invention has been explained in relation to its preferred embodiment, it is to be understood that many other possible modifications and variations can be made without departing from the spirit and scope of the invention as hereinafter claimed.

What is claimed is:

1. An adjustable dead bolt assembly, comprising;

a lock case mounted to a face plate, a dead bolt being partially and slidably received in the lock case and including a pair of operative rods attached to the dead bolt to move therewith, each said operative rod including a first protrusion and a second protrusion projecting therefrom;

a pair of plates fixed to the lock case, each said plate including an oblong hole defined therein, at least one of the plates including a recessed section formed in an inner side thereof, the recessed section including a sidewall extending along at least one of two lateral sides defining part of the oblong hole, said at least one of the plates including at least one inwardly directed protruded section formed in the sidewall of the recessed section, the protruded section being located midway along a lateral side of the oblong hole and directed inwardly towards the oblong hole; and an actuating wheel slidably mounted between the plates and slidable along the oblong holes, said actuating wheel including a pair of teeth for selectively engaging with the first protrusions and the second protrusions, said actuating wheel further including a shoulder formed on a first side thereof, a spring being mounted around the shoulder in a compressed manner such that the spring is expandible into the recessed section around the oblong hole for positioning the actuating wheel.

2. The adjustable dead bolt assembly according to claim 1, further comprising a retainer plate mounted to the inner side of one of the plates, said retainer plate including a hole and a projection, said actuating wheel further comprising a second shoulder formed on the other side thereof and being fittingly received in the hole of the retainer plate, and said actuating wheel further comprising a flange against which the projection of the retainer plate bears.

3. The adjustable dead bolt assembly according to claim 1, wherein each said plate includes two said protruded sections respectively formed in the sidewall of the recessed section, and said two protruded sections being spaced a sufficient distance to permit passage of the actuating wheel therebetween from one end of the oblong hole to the other end of the oblong hole.

* * * * *